US011768014B2

(12) United States Patent
Sishtla et al.

(10) Patent No.: US 11,768,014 B2
(45) Date of Patent: Sep. 26, 2023

(54) SURGE PROTECTION FOR A MULTISTAGE COMPRESSOR

(71) Applicant: Carrier Corporation, Palm Beach Gardens, FL (US)

(72) Inventors: Vishnu M. Sishtla, Palm Beach Gardens, FL (US); Lei Yu, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 329 days.

(21) Appl. No.: 17/255,908

(22) PCT Filed: Jun. 29, 2020

(86) PCT No.: PCT/US2020/040041

§ 371 (c)(1),
(2) Date: Dec. 23, 2020

(87) PCT Pub. No.: WO2021/003080

PCT Pub. Date: Jan. 7, 2021

(65) Prior Publication Data

US 2022/0186985 A1 Jun. 16, 2022

Related U.S. Application Data

(60) Provisional application No. 62/869,494, filed on Jul. 1, 2019.

(51) Int. Cl.
*F04D 27/02* (2006.01)
*F25B 1/053* (2006.01)
(Continued)

(52) U.S. Cl.
CPC ..... *F25B 1/053* (2013.01); *F04D 5/003* (2013.01); *F04D 17/12* (2013.01);
(Continued)

(58) Field of Classification Search
CPC ..... F25B 1/053; F05D 2260/80; F05D 2270/101; F04D 5/003; F04D 17/12; F04D 27/0207; F04D 27/0215; F04D 27/0269
See application file for complete search history.

(56) References Cited

U.S. PATENT DOCUMENTS 3,111,968 A * 11/1963 Headrick ..... B64F 1/28 222/330
3,390,545 A 7/1968 Hoffman
(Continued)

FOREIGN PATENT DOCUMENTS

CN 101018994 8/2007
CN 102177347 9/2011
(Continued)

OTHER PUBLICATIONS

International Preliminary Report on Patentability for International Patent Application No. PCT/US2020/040041 dated Dec. 28, 2021.
(Continued)

*Primary Examiner* — Eldon T Brockman
*Assistant Examiner* — Andrew J Marien
(74) *Attorney, Agent, or Firm* — Carlson, Gaskey & Olds, P.C.

(57) ABSTRACT

A coolant system includes a multistage compressor having a plurality of surge detection sensors. A condenser is connected to an outlet of the multistage compressor. An economizer is connected to an outlet of the condenser and has a gaseous coolant outlet and a liquid coolant outlet. The liquid coolant outlet is connected to a cooler and the gaseous coolant outlet is connected to a second or later stage of the multistage compressor via a controllable valve. A controller is communicatively coupled to the surge detection sensors and the controllable valve. The controller includes a non-transitory medium storing instructions for causing the con-
(Continued)

troller to detect an occurrence of a surge and restricting a flow through the controllable valve until the surge has ceased.

20 Claims, 2 Drawing Sheets

(51) Int. Cl.
*F04D 17/12* (2006.01)
*F04D 5/00* (2006.01)

(52) U.S. Cl.
CPC ..... *F04D 27/0207* (2013.01); *F04D 27/0269* (2013.01); *F05D 2260/80* (2013.01); *F05D 2270/101* (2013.01)

(56) References Cited

U.S. PATENT DOCUMENTS

| | | | | |
|---|---|---|---|---|
| 4,457,768 | A * | 7/1984 | Bellinger | F25J 1/0022 62/172 |
| 4,787,211 | A * | 11/1988 | Shaw | F25B 49/022 417/248 |
| 5,095,712 | A * | 3/1992 | Narreau | F25B 5/02 62/200 |
| 5,174,729 | A * | 12/1992 | Waters | F04D 27/0207 417/310 |
| 6,374,631 | B1 | 4/2002 | Lifson et al. | |
| 6,973,797 | B2 * | 12/2005 | Nemit, Jr. | F25B 41/20 162/197 |
| 7,895,852 | B2 | 3/2011 | Crane et al. | |
| 8,136,364 | B2 | 3/2012 | Lifson et al. | |
| 8,312,737 | B2 * | 11/2012 | Bush | F25B 41/00 62/513 |
| 8,418,482 | B2 | 4/2013 | Bush et al. | |
| 8,459,049 | B2 * | 6/2013 | Li | F25B 5/02 62/113 |
| 9,696,074 | B2 | 7/2017 | Ceccarelli et al. | |
| 9,746,218 | B2 | 8/2017 | Sommer et al. | |
| 9,951,974 | B2 | 4/2018 | Huff et al. | |
| 10,088,202 | B2 | 10/2018 | Huff et al. | |
| 2014/0182317 | A1 | 7/2014 | Sishtla et al. | |
| 2014/0260388 | A1 | 9/2014 | Umeda et al. | |
| 2014/0314543 | A1 * | 10/2014 | Park | F04D 27/0215 415/146 |
| 2015/0128640 | A1 * | 5/2015 | Sun | F25B 1/10 415/55.5 |
| 2016/0053764 | A1 * | 2/2016 | Abdelwahab | F25J 3/04678 417/53 |
| 2016/0272047 | A1 | 9/2016 | Mingfei | |
| 2017/0248355 | A1 | 8/2017 | Knopp et al. | |

FOREIGN PATENT DOCUMENTS

| | | |
|---|---|---|
| CN | 103307795 | 9/2013 |
| CN | 103759482 | 4/2014 |
| CN | 104864620 | 8/2015 |
| CN | 105114327 | 12/2015 |
| CN | 106460834 | 2/2017 |
| CN | 107255371 | 10/2017 |
| CN | 109099607 | 12/2018 |
| CN | 208779744 | 4/2019 |
| EP | 2245387 | 12/2017 |
| GB | 2003263 | 3/1979 |
| JP | 2002322996 | 11/2002 |
| WO | 2017023578 | 2/2017 |
| WO | 2018089336 | 5/2018 |

OTHER PUBLICATIONS

International Search Report and Written Opinion for International Patent Application No. PCT/US2020/040041 dated Sep. 22, 2020.

* cited by examiner

SURGE PROTECTION FOR A MULTISTAGE COMPRESSOR

CROSS-REFERENCE TO RELATED APPLICATION

This application claims priority to U.S. Provisional Application No. 62/869,494 filed on Jul. 1, 2019.

TECHNICAL FIELD

The present disclosure relates generally to multistage compressors for coolant systems, and more specifically for a system for preventing surge conditions in the same.

BACKGROUND

Coolant systems, such as those used to supply compressed coolant to a building, or other structure, can take the form of a two stage refrigeration system. Such systems utilize an economizer (or flash tank) to achieve efficient cooling performance and maintain desired discharge pressure and temperature at high ambient temperatures. In such systems, a portion of the coolant is transitioned to a gaseous state in the economizer, and the gaseous portion is returned to the later stage of the compressor.

Some existing systems utilize a fixed opening connecting the gaseous coolant to the later stage. The additional gas, due to the gaseous coolant injection, can create back pressure within previous stages in the compressor. When the back pressure gets too high a surge occurs. One existing process for preventing a surge is to include a bypass flowpath that routes the gaseous coolant to the inlet of the first stage of the compressor when a surge is detected. This solution results in efficiency losses within the overall coolant system.

SUMMARY OF THE INVENTION

In one exemplary embodiment a coolant system includes a multistage compressor including a plurality of surge detection sensors, a condenser connected to an outlet of the multistage compressor, an economizer connected to an outlet of the condenser and having a gaseous coolant outlet and a liquid coolant outlet; the liquid coolant outlet being connected to a cooler and the gaseous coolant outlet being connected to a second or later stage of the multistage compressor via a controllable valve, and a controller communicatively coupled to the surge detection sensors and the controllable valve, the controller including a non-transitory medium storing instructions for causing the controller to detect an occurrence of a surge and restricting a flow through the controllable valve until the surge has ceased.

In another example of the above described coolant system the compressor includes greater than two stages of compression.

Another example of any of the above described coolant systems further includes at least one additional economizer having a gaseous coolant outlet connected to a second or later stage of the multistage compressor.

In another example of any of the above described coolant systems each of the economizers is arranged in fluid parallel with at least one other economizer.

In another example of any of the above described coolant systems each of the economizers is arranged in fluid series with at least one other economizer.

In another example of any of the above described coolant systems each economizer is connected to a corresponding second or later stage of the multistage compressor, and wherein restricting flow through the controllable valve in response to detecting a surge includes restricting a valve connecting one of the economizers to the stage causing the surge.

In another example of any of the above described coolant systems each economizer is connected to a corresponding second or later stage of the multistage compressor, and wherein restricting flow through the controllable valve in response to detecting a surge includes restricting each valve connecting one the economizers to the second or later stage.

In another example of any of the above described coolant systems the non-transitory medium further stores instructions configured to cause the controller to open flow through the controllable valve in response to detecting the surge ceasing.

In another example of any of the above described coolant systems the non-transitory medium further stores instructions configured to cause the controller to open flow through the controllable valve after a predetermined time has elapsed since detection of the surge.

In another example of any of the above described coolant systems the non-transitory memory further stores instructions for causing the controller to open flow through the controllable valve in response to detecting that the surge has ceased.

In another example of any of the above described coolant systems restricting flow through the controllable valve comprises restricting only controllable valves connected to a stage of the multi-stage compressor causing the surge.

Another example of any of the above described coolant systems further includes at least a second controllable valve, and wherein restricting flow through the controllable valve includes restricting flow through the controllable vale and the at least the second controllable valve.

An exemplary method for preventing surge in a multi-stage compressor based coolant system includes detecting an occurrence of a surge and restricting a flow through at least one valve connecting an economizer to a second or later stage of the multi-stage compressor until the surge has ceased.

Another example of the above described method for preventing surge in a multistage compressor based coolant system further includes opening flow through the valve in response to detecting that the surge has ceased.

In another example of any of the above described methods for preventing surge in a multistage compressor based coolant system restricting flow through the valve includes restricting only valves connected to a stage of the multi-stage compressor causing the surge.

In another example of any of the above described methods for preventing surge in a multistage compressor based coolant system the at least one valve includes a plurality of valves and restricting flow through the valve comprises restricting each valve in the plurality of valves.

These and other features of the present invention can be best understood from the following specification and drawings, the following of which is a brief description.

DETAILED DESCRIPTION

Figure 1:
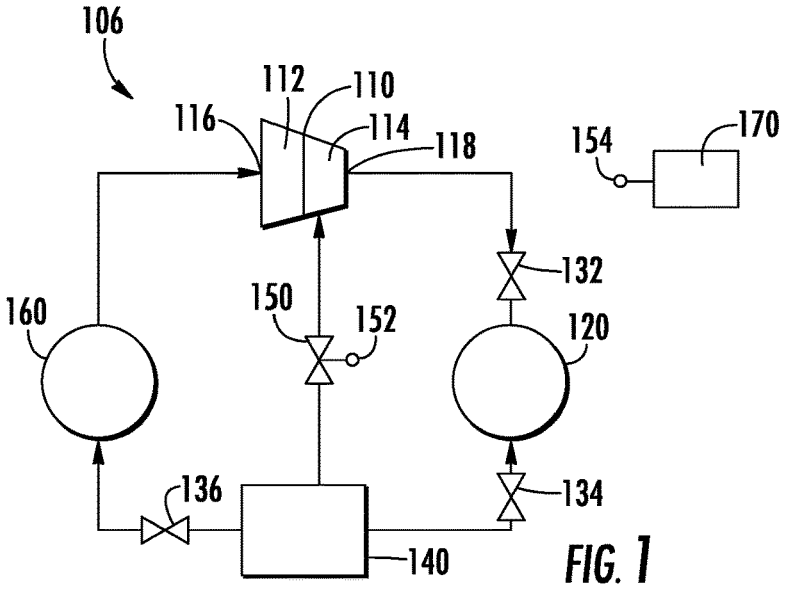
FIG. 1 illustrates an exemplary coolant system including a multi-stage compressor.

FIG. 1 schematically illustrates an exemplary building cooling system 100. The cooling system 100 is a closed loop system including a multi-stage compressor 110 having an upstream stage 112 and a downstream stage 114. In alternative examples, three or more stages of the compressor 110 can be utilized, depending on the characteristics of the specific cooling system 100, additional stages beyond two can be used in the multi-stage compressor 110.

The compressor 110 receives a coolant at an upstream inlet 116 and compresses the coolant across the compressor 110. An outlet 118 provides the coolant to a condenser 120 through a first valve 132. In the condenser 120, the coolant is condensed to a liquid state and stored in a compressed condition. The coolant from the condenser 120 is provided to an economizer 140 through a second valve 134. The economizer 140 flashes a portion of the condensed liquid coolant into a gaseous form of the coolant. By flashing the portion of the coolant, energy is expended in the state change and the remaining coolant is further cooled in the economizer 140.

The flashed portion of the coolant is provided back to the second stage 114 of the compressor 110 through a controlled valve 150. The controlled valve 150 is any valve that is able to be actively controlled by a controller and has multiple states including fully open, fully closed and at least one transitional state between fully open and fully closed. The non-flashed portion of the coolant is provided to a cooler 160 through a valve 136. While not expressly described and illustrated herein, the valves 132, 134, 136 can be controlled or passive, according to any known valve architecture.

The controlled valve 150 includes a control input 152 that is connected to a control output 154 of a controller 170. The controller 170 includes a processor and a memory, and is connected to one or more sensors within the compressor 110 and a remainder of the cooling system 100. The controller 170 uses the sensors to detect when a surge is occurring within the compressor 110 according to any known surge detection process. It is appreciated that the occurrence of surge can be decreased or eliminated by a decrease in the amount of gaseous coolant being injected into the later stage 114 of the compressor 110. When a surge is detected by the controller 170, the controller 170 outputs a signal at the control output 154 and the signal is received at the control input 152 of the controllable valve 150. The signal causes the controllable valve 150 to begin restricting flow of gaseous coolant into the second stage 114 of the compressor 110.

As the valve 150 restricts the flow of gaseous coolant, the controller 170 continues to use the sensors to monitor the surge conditions in the compressor 110. Once the surge conditions have decreased to a suitable level, the controller 170 stops restricting the controllable valve 150, and holds the controllable valve 150 in position. After a predetermined amount of time, the controllable valve 150 is allowed to reopen. If a surge condition occurs as the controllable valve 150 is reopened, the process reiterates, and the valve 150 is restricted again.

In some alternative examples, the controllable valve 150 is continuously controlled to either open or close by the controller 170, and there is no period of time between stopping the restriction and beginning to reopen the valve 150. Such examples utilize a feedback control loop to maintain an amount of restriction at the valve 150 sufficient to prevent surge.

In some examples, where additional stages are utilized in the compressor 110 (e.g. three or more stages), additional economizers 140 can be used as well.

Figure 2:
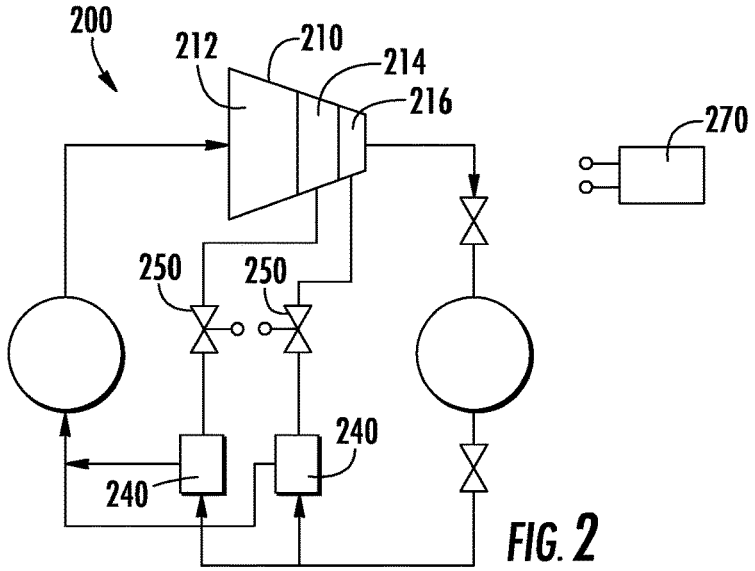
FIG. 2 schematically illustrates an alternative example coolant system including a multi-stage compressor.

FIG. 2 illustrates an example coolant system including a multi-stage compressor 210 having three stages 212, 214, 216. As there are two downstream stages 214, 216, the system 200 of FIG. 2 includes two economizers 240, with each of the economizers 240 being connected in fluid parallel with each other. Each economizer 240 is connected to a corresponding one of the downstream stages 214, 216 via a corresponding controllable valve 250. Each of the controllable valves 250 is connected to, and controlled by a controller 270 in the same manner as the controllable valve 150 of the example of FIG. 1. In alternative examples, multi-stage compressors having three or more stages can include a single economizer 240.

In some examples, the controller 270 can determine where the surge is occurring within the compressor 210, and restrict the valve 250 corresponding to only the compressor stage 214, 216 causing the surge. In other examples, the controller may be limited by the sensors available within the compressor 210 and can only determine that a surge is occurring, without being able to determine which stage 214, 216 is causing the surge. In such an example, the controller 270 restricts the controllable valves 250 simultaneously until the surge condition dissipates. Once the surge condition dissipates the controller 270 can either wait, or engage in active control as with the valve of FIG. 1.

Figure 3:
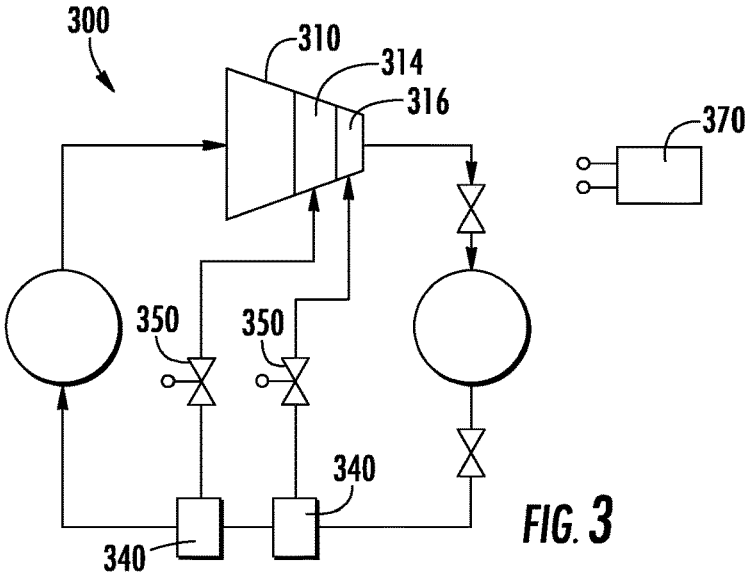
FIG. 3 schematically illustrates a second alternative example coolant system including a multi-stage compressor.
Figure 4:
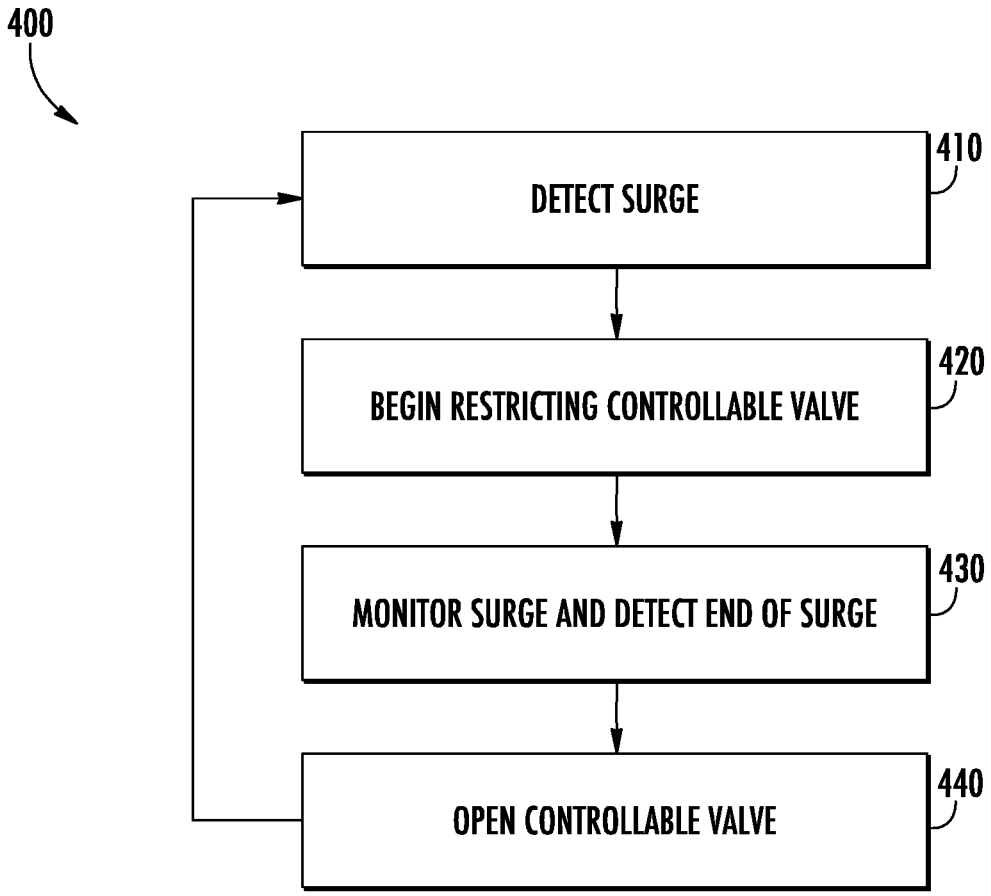
FIG. 4 illustrates a feedback loop for controlling a restricted state of a controllable valve.

With continued reference to FIGS. 1 and 2, FIG. 3 schematically illustrates another alternative system 300 including a three stage compressor 310. In the example of FIG. 3, multiple economizers 340 are connected in fluid series, with the gaseous output of the downstream economizer 340 being connected to the second stage 314 of the compressor 310 and the gaseous output of the upstream economizer 340 being connected to the third stage 316 of the compressor 310. The controller 370 is connected to the controllable valves 350 and controls the controllable valves 350 in the system 200 of FIG. 2.

With continued reference to FIGS. 2 and 3, it is appreciated that while each example illustrates two economizers 240, 340 the architecture can be expanded to include any number of economizers, with the number of economizers being limited to one less than the number of stages in the compressor 210, 310. In alternative examples, multiple economizers can be connected to a single later stage of the compressor 210, 310 and the number of economizers is not limited by the number of stages in the compressor 210, 310.

With continued reference to FIGS. 1-3, FIG. 4 illustrates a feedback loop process 400 for reducing and eliminating a surge condition in any of the systems 100, 200, 300 of FIGS. 1-3. Initially the controller detects a surge in a "Detect Surge" step 410. The detection uses existing sensors contained within the compressor and any standard surge detection method.

When a surge condition is detected, the controller begins restricting the opening of a controllable valve in a "Begin Restricting Controllable Valve" step 420. As described above, the restriction can be all controllable valves, or only a controllable valve connected to the compressor stage causing the surge. Once restricting has begun the amount of fluid passed through the controllable valve(s) is continuously reduced, and the surge conditions in the compressor are monitored in a "Monitor Surge and Detect End of Surge" step 430.

When the end of the surge is detected by the controller, the controller responds by beginning to unrestricted, or open, the controllable valve(s) in an "Open Controllable Valve" step 440. As before, the surge conditions are continuously monitored, and the feedback loop reiterates when a surge is detected in the detect surge step 410.

By using the feedback loop, the controller can maintain the controllable valve(s) in the idea position to allow the most gaseous coolant to be returned to the later stages of the compressor, while at the same time ensuring that a surge condition does not occur within the compressor.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A coolant system comprising:

a multistage compressor including a plurality of surge detection sensors;

a condenser connected to an outlet of the multistage compressor;

an economizer connected to an outlet of the condenser and having a gaseous coolant outlet and a liquid coolant outlet; the liquid coolant outlet being connected to a cooler and the gaseous coolant outlet being connected to a second or later stage of the multistage compressor via a controllable valve; and a controller including a non-transitory medium storing instructions for causing the controller to detect an occurrence of a surge based on an indication from at least one of the surge detection sensors, to restrict a flow through the controllable valve until the surge has ceased, and to open the flow through the controllable valve in response to detecting the surge ceasing.

2. The coolant system of claim 1, wherein the multistage compressor comprises greater than two stages.

3. The coolant system of claim 2, further comprising at least one additional economizer having a gaseous coolant outlet connected to a second or later stage of the multistage compressor.

4. The coolant system of claim 3, wherein each of the economizers is arranged in fluid parallel with at least one other economizer.

5. The coolant system of claim 3, wherein each of the economizers is arranged in fluid series with at least one other economizer.

6. The coolant system of claim 3, wherein each economizer is connected to a corresponding second or later stage of the multistage compressor, and wherein the controller restricts the flow through the controllable valve by restricting a valve connecting one of the economizers to the stage causing the surge.

7. The coolant system of claim 3, wherein each economizer is connected to a corresponding second or later stage of the multistage compressor, and wherein the controller restricts the flow through the controllable valve by restricting each valve connecting one the economizers to the second or later stage.

8. The coolant system of claim 1, wherein restricting the flow through the controllable valve comprises restricting only controllable valves connected to a stage of the multistage compressor causing the surge.

9. The coolant system of claim 1, further comprising at least a second controllable valve, and wherein restricting the flow through the controllable valve comprises restricting the flow through the controllable valve and the second controllable valve.

10. A method for preventing surge in a multistage compressor based coolant system comprising:

detecting an occurrence of a surge;

restricting a flow through at least one valve connecting an economizer to a second or later stage of the multistage compressor until the surge has ceased; and opening the flow through the at least one valve in response to detecting that the surge has ceased.

11. The method of claim 10, wherein restricting the flow through the at least one valve comprises restricting only valves connected to a stage of the multi-stage compressor causing the surge.

12. The method of claim 10, wherein the at least one valve comprises a plurality of valves and restricting the flow through the at least one valve comprises restricting each valve in the plurality of valves.

13. A coolant system comprising:

a multistage compressor including a plurality of surge detection sensors;

a condenser connected to an outlet of the multistage compressor;

an economizer connected to an outlet of the condenser and having a gaseous coolant outlet and a liquid coolant outlet; the liquid coolant outlet being connected to a cooler and the gaseous coolant outlet being connected to a second or later stage of the multistage compressor via a controllable valve; and a controller including a non-transitory medium storing instructions for causing the controller to detect an occurrence of a surge based on an indication from at least one of the surge detection sensors, to restrict a flow through the controllable valve until the surge has ceased, and to cause the controller to open the flow through the controllable valve after a predetermined time has elapsed since detection of the surge.

14. The coolant system of claim 13, wherein the multistage compressor comprises greater than two stages.

15. The coolant system of claim 14, further comprising at least one additional economizer having a gaseous coolant outlet connected to a second or later stage of the multistage compressor.

16. The coolant system of claim 15, wherein each of the economizers is arranged in fluid parallel with at least one other economizer.

17. The coolant system of claim 15, wherein each of the economizers is arranged in fluid series with at least one other economizer.

18. The coolant system of claim 15, wherein each economizer is connected to a corresponding second or later stage of the multistage compressor, and wherein the controller restricts the flow through the controllable valve by restricting a valve connecting one of the economizers to the stage causing the surge.

19. The coolant system of claim 15, wherein each economizer is connected to a corresponding second or later stage of the multistage compressor, and wherein the controller restricts the flow through the controllable valve by restricting each valve connecting one the economizers to the second or later stage.

20. The coolant system of claim 13, wherein restricting the flow through the controllable valve comprises restricting only controllable valves connected to a stage of the multi-stage compressor causing the surge.

* * * * *